United States Patent [19]

Marcoux

[11] Patent Number: 4,582,234

[45] Date of Patent: Apr. 15, 1986

[54] DISPENSING CARTON

[76] Inventor: Emery Marcoux, 53, chemin du Grand Moulin, Deux-Montagnes, Canada, J7R 3C3

[21] Appl. No.: 708,152

[22] Filed: Mar. 4, 1985

[51] Int. Cl.[4] ..... B65D 85/671

[52] U.S. Cl. ..... 225/48; 225/53; 225/90

[58] Field of Search ..... 225/48–50, 225/53, 26, 90

[56] References Cited

U.S. PATENT DOCUMENTS

| | | | |
|---|---|---|---|
| 3,281,034 | 10/1966 | Woodling | 225/48 |
| 3,845,894 | 11/1974 | Merlin . | |
| 4,119,251 | 10/1978 | Golner et al. | 225/53 X |
| 4,307,828 | 12/1981 | Sias et al. . | |

FOREIGN PATENT DOCUMENTS

| | | |
|---|---|---|
| 716927 | 8/1965 | Canada . |
| 885302 | 11/1971 | Canada . |
| 1004639 | 2/1977 | Canada . |

*Primary Examiner*—Frank T. Yost

[57] ABSTRACT

An improved dispensing carton for polymeric film having cling properties. The carton has a front wall with an upper edge and contains a roll of the film material. A flap is arranged to project outwardly downwardly in use condition, from the upper edge, being preferably integrally formed with the front wall. The leading edge portion of the film clings to the upper surface of the flap to prevent retraction of the film after a section is severed in the known manner. The flap is formed with at least one notch at its outer edge for grasping the edge portion of the film. An alternate embodiment provides a similar flap as part of a separate strip insertable into the carton.

4 Claims, 3 Drawing Figures

Fig. 1
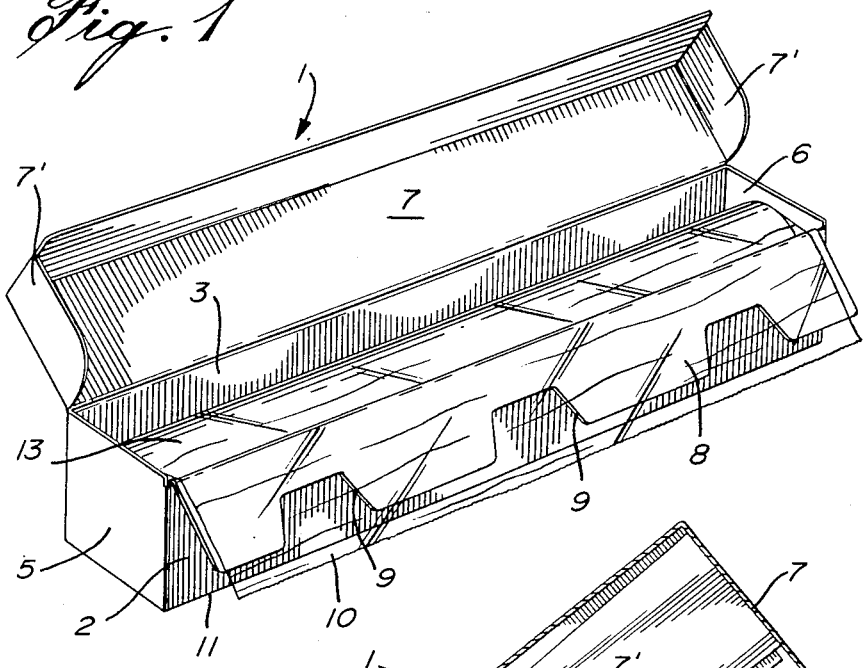
Fig. 2
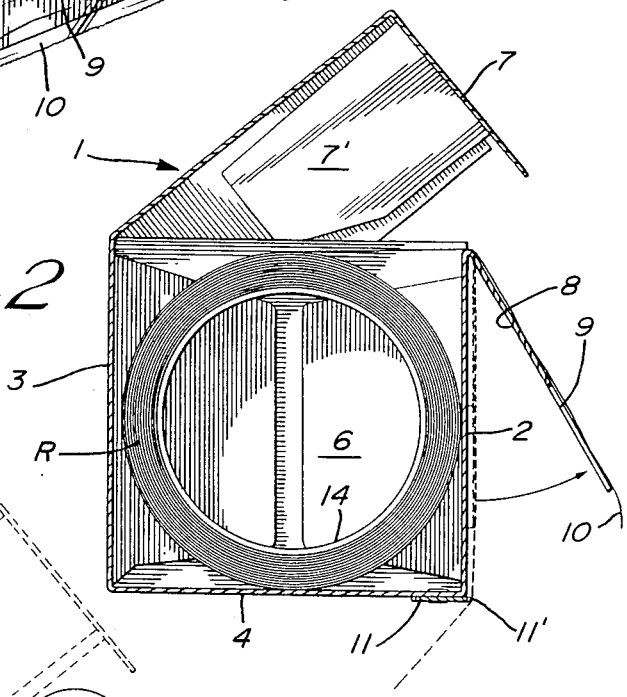
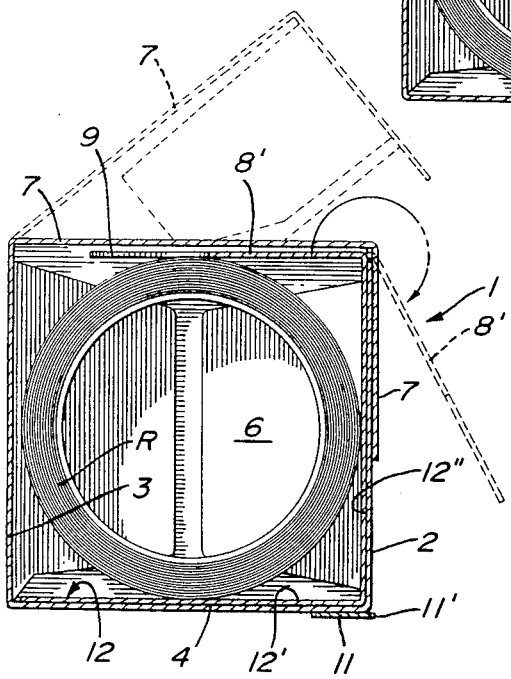
Fig. 3

DISPENSING CARTON

FIELD OF THE INVENTION

The present invention relates generally to containers adapted to dispense a roll of sheet material, more particularly to an improved carton which dispenses polymeric film having cling characteristics.

BACKGROUND OF THE INVENTION

Polymeric film with cling is nowadays commonly used domestically as a wrapping material for food, for example. The film is popular and desirable, because of its natural "cling" characteristics, that is its ability to stick to itself and to form an intimate contact with smooth surfaces. During cool dry weather, it also has a tendency to acquire a static electric charge, thus making the film suitable for use in a refrigerator.

It is known to provide containers for polymeric film wherein the latter is placed as a roll. The container is formed with an aperture for the leading edge of the roll, so that the leading edge can be pulled out of the container. Cutting means are provided with the container, allowing a user to tear off a sheet section of the film for use as needed.

Even with the cutter spaced away from the aperture, it has been found that the leading edge of the film has a tendency to retract into the supply roll due to its elasticity, cling and other factors. When this occurs, it is very troublesome and difficult to locate the leading edge, because of the thinness of the film. It then becomes necessary to open the container and even lift out the supply roll to separate the leading portion of the film.

Moreover, due to its cling, the leading edge has a tendency to crinkle and fold upon itself after a section has been cut.

The prior art has taught several improvements in such containers or cartons. For example, the Canadian Patent issued to Hebert on Aug. 31, 1965 and bearing No. 716,927 discloses a container having a longitudinal slit in its front wall through which the sheet material can pass. A downwardly- outwardly-positionable flap 17 is made to project from the slit (see FIG. 3 of the patent). The cutting means is disposed along the outer edge of the flap. There are two main disadvantages to this design:

(a) the film will adhere to the outer surface of the flap, thereby making it difficult to pull;

(b) more importantly, a user wishing to pull at the leading edge runs the risk of scratching or even cutting his/her fingers on the cutter, since the latter is at the outer edge of the flap.

Other patents teach the use of tack spots on the front-dispensing wall of the container, or pressure adhesives according to relatively-elaborate construction.

OBJECTS OF THE INVENTION

In view of the above, it is a prime object of the present invention to provide an improved dispensing carton for polymeric film rolls having cling properties, which obviates the above disadvantages and which is very simple in design.

SUMMARY OF THE INVENTION

The above and other objects and advantages of the present invention are realized according to preferred embodiments comprising a standard dispensing carton formed of a bottom wall, a rear wall, two side walls, a front wall and a cover hingedly attached to the upper edge of the rear wall and adapted to close over the upper portion of the front wall. A roll of polymeric film material is disposed inside the carton.

The improvement feature of the invention consists of a flap having a folding means, preferably formed with the upper edge of the front wall. The flap in use position extends downwardly outwardly from the front wall, terminating short of the lower end of the front wall. A conventional cutting means is located at the junction of the front wall with the bottom wall.

When the leading edge of the film is pulled out of the container and a section thereof is severed in the usual manner, the film adheres to the outer surface of the flap. At least one notch is formed in the flap, so that the film may be grasped very easily.

The flap may be integrally formed with the front wall, as stated, or it may be a part of a separate strip of foldable material inserted into the carton.

BRIEF DESCRIPTION OF THE DRAWINGS

The above will be clearly understood by having referral to the preferred embodiments of the invention, illustrated by way of the accompanying drawings, in which:

FIG. 1 is a perspective view of the dispensing carton;

FIG. 2 is a cross-section of the carton in open dispensing condition; and

FIG. 3 is a cross-section of a second embodiment of the invention in closed shipping condition.

Like numerals refer to like elements throughout the drawings.

DETAILED DESCRIPTION OF THE PREFERRED EMBODIMENT

Carton 1 has a front wall 2, a rear wall 3, a bottom wall 4, two side walls 5, 6 and a cover 7. The latter is formed with side portions 7'.

A cutting bar 11, made of metal and having serrated cutting teeth 11', is secured to bottom wall 4 with the teeth projecting slightly forwardly of front wall 2.

A roll R of polymeric film 13, having cling properties, is disposed in carton 1 and may be unrolled either from the bottom or the top. Roll R is rolled around a roller 14.

In accordance with the invention, a flap 8 is made to project outwardly, downwardly from the top edge of front wall 2.

Flap 8 may be integrally formed with front wall 2, in which case the folding means is a fold-line at the top edge of the front wall 2. Since the carton material is somewhat resilient, the outer edge of flap 8 will be spaced away from front wall 2.

Three notches 9 are made in the outer edge of flap 8, so that the leading edge portion 10 of the polymeric film material 13 can be easily grasped between thumb and forefinger and then severed along the cutting bar 11 in the known manner.

For shipping purposes, flap 8 is folded backwardly over roll R and cover 7 is detachably secured to front wall 2, as with glue.

According to a second embodiment of the invention, flap 8 forms a portion of a separate strip of carton material 12 adapted to be disposed in carton 1. Referring to FIG. 3, strip 12 is shown as having three sections or portions, including a lower portion 12' placed between roll R and bottom wall 4, a vertical portion 12'' hugging the inner surface of front wall 2 and a top portion which forms a flap 8'. As in the main embodiment, flap 8 can be folded backwardly over the top of roll R for shipping purposes.

It is to be noted that in both embodiments, the folding means at the top edge of front wall 2 provides a smooth guide for the leading edge portion of film 13, such that the latter can be pulled out of the carton without wrinkling at its lateral edges.

What I claim is:

1. A dispensing carton for film having cling properties, comprising: a bottom wall, a rear wall, a pair of side walls, a front wall and a cover hingedly secured to the upper edge of said rear wall and closable over said front wall; a roll of said film disposed within the carton and having a leading portion; a flap formed with said front wall and having a folding means at the upper edge of said front wall; said flap projecting downwardly, outwardly from said upper edge of said front wall in use condition and having at least one notch formed in its outer edge; said flap being backwardly foldable over the top of said roll for shipping purposes; cutting means at the junction of said front wall and said bottom wall.

2. A dispensing carton as defined in claim 1, wherein said folding means is a fold-line.

3. A dispensing carton as defined in claim 1, wherein there are three notches formed in said outer edge of said flap.

4. A dispensing carton for film having cling properties, comprising: a bottom wall, a rear wall, a pair of side walls, a front wall and a cover hingedly secured to the upper edge of said rear wall and foldable over said front wall; a roll of said film disposed within said carton and having a leading portion; a separate strip of carton material adapted to be disposed in the carton; said separate strip having a lower portion disposed between said roll and said bottom wall; a vertical portion contiguous with the inner surface of said front wall and a flap portion; the latter projecting outwardly downwardly from a folding means at the upper edge of said front wall; said flap portion being backwardly foldable over the top of said roll for shipping purposes; said flap portion having at least one notch formed at its outer edge; cutting means at the junction of said bottom wall and said front wall.

* * * * *